United States Patent [19]

Catania

[11] 4,124,237

[45] Nov. 7, 1978

[54] MACRAME-MAKING STAND

[76] Inventor: Salvatore J. Catania, 131 N. 40th St., Omaha, Nebr. 68131

[21] Appl. No.: 748,924

[22] Filed: Dec. 9, 1976

[51] Int. Cl.[2] ..... D04G 5/00

[52] U.S. Cl. ..... 289/18

[58] Field of Search ..... 28/15, 149; 289/18; 248/511, 518, 519; 211/190

[56] References Cited

U.S. PATENT DOCUMENTS

| | | | |
|---|---|---|---|
| 1,203,781 | 11/1916 | Ratycia | 28/15 |
| 1,406,571 | 2/1922 | McCoy | 248/519 X |
| 2,749,067 | 6/1956 | Gorenflo | 248/511 |
| 2,782,937 | 2/1957 | Schlissel | 211/190 X |

*Primary Examiner*—Louis K. Rimrodt

*Attorney, Agent, or Firm*—Hiram A. Sturges

[57] ABSTRACT

The Macrame-Making Stand, comprising of base with astandard extending up from it, the base being for receiving the weight of a person who is either sitting on the base while it is on a seat of a chair or else is standing on the base when the base is on the floor, the standard being of adjustable length and pivoting with respect to the base for swinging forwardly at its upper end and adapted to be locked in a precept position, this standard being of adjustable heights, anchoring means for a Macrame Loop on the upper end of the standard.

The anchoring means comprising, in one form, a pluralitive of hooks adjustably mounted so as to be rotated into storage positions.

12 Claims, 6 Drawing Figures

MACRAME-MAKING STAND

FIELD OF THE INVENTION

This invention is in the field of supports or stands for holding portions of macrame weavings.

DESCRIPTION OF THE PRIOR ART

In the prior art, there has not been, to my knowledge, a stand useful for supporting portions of macrame while pot holders or wall hangings or the like are being made which latter has my concept of a base on which the weight of the operator is disposed while providing the stand with stability. My concept involves having the base proved with its major portion disposed to one side of a place at which the base attaches to a standard so that the operator can have his or her weight on the base without the top of the standard being excessively close.

Although the idea of a telescoping stand having a telescoping standard was available heretofore in a weaving frame for other purposes, yet to my knowledge, it has not been used in Macrame-Making Stands.

Also to my knowledge, there has not been in the prior art any ring-hocks or macrame loop holders adapted for the top of a standard, which are of a form practical for macrame work.

SUMMARY OF THE INVENTION

A particular object is to provide a Macrame-Making Stand comprising a base, having a normally horizontally disposed upper surface on which the weight of an operator can be placed giving the stand stability, the majority of the area of the base, as seen from the top, being disposed to a rearward side of that place on the base at which the lower end of the standard is attached so that the standard is spaced from the operator to a sufficient degree, the standard being vertically adjustable to various heights and the standard having an anchor means at its upper end for receiving a loop or ring portion of the macrame.

A particular object is to provide a special anchor means in the form of a ring-hock suitable for receiving a ring to which macrame material is attached. A further object is to provide a special anchor means for the top of the standard which comprises a plurality of hooks adapted to be twisted from operating positions into storage positions because the hooks are pivotally mounted on a cross bar extending transversely to the standard. Still a further object is to provide the concept of mounting the base on the top of a chair so that an operator can sit on the base and in which the base has a narrower portion extending forwardly from a wider portion, the narrower portion having at its forward end means attaching the standard to the base.

A further object is to provide the concept of having a standard pivotally mounted with respect to the base for rotation about a horizontal axis transversed to the standard and for being set in any one of a plurality of positions with the upper end of the standard extending forwardly various amounts by pivoting about said horizontal axis and being locked in position at a desired place.

Yet a further object is to provide a stand in which the way of attaching the standard to the base permits a pivoting about an axis horizontally disposed rearwardly from the lower end of the standard, the latter axis being a vertical axis whereby the standard can be swung to one side or another of the forward end of the base so as to be settable in various positions and locked in such positions for giving the positioning of the standard a still greater variety.

Still a further object is to provide the concept of having a narrower forward portion of a base so the operator's legs can extend along side each side of the forward portion while his or her buttocks are sitting on the major portion of the base which latter is then disposed above a chair seat.

A particular object is to provide the concept of having a chair in combination with a macrame stand so that together they form what is in effect a standard assembly for holding the standard in a desired position for use when an operator desires to work while sitting down.

Still another object is to provide a starting hook about 12 inches above the base to receive a macrame ring at a time when the macrame product is just starting to be made.

DESCRIPTION OF THE PREFERRED EMBODIMENT

Figure 1:
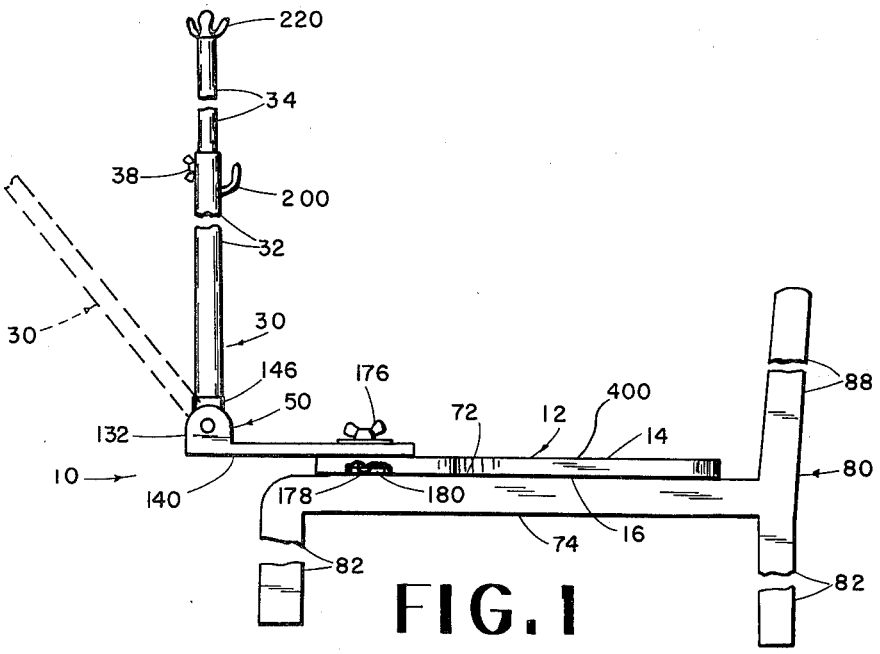
FIG. 1 is a side elevation of a macrame-making stand of this invention with portions thereof removed and with the standard shown in dotted lines in an optional forwardly inclined position.
Figure 2:
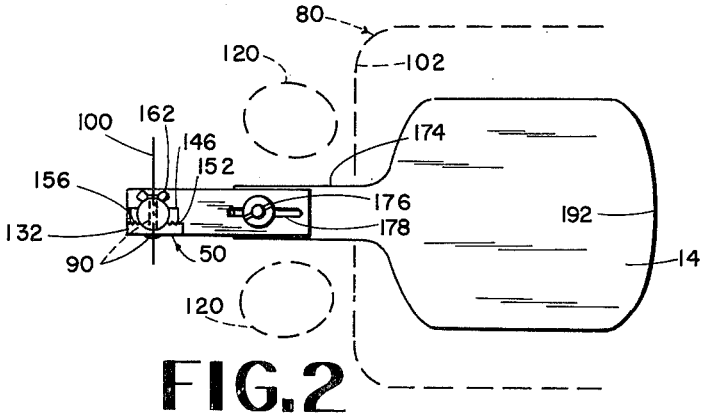
FIG. 2 is a top plan view of a macrame-making stand of FIG. 1 showing the stand as disposed on the top of a seat whereby an operator can sit on the base of this stand for providing stability, the seat being shown partially in dotted lines and partially full lines, rearward portions of the seat not being shown at all; certain oval lines showing the position of the calves of an operator's legs at a time when the operator, not shown, is sitting on the base while it is on a chair or seat.

The macrame support stand or macrame-making stand of this invention is generally indicated at 10 in FIG. 1, and comprises a base 12, having a normally horizontal upper surface 14. The underside of the base has lowermost points lying substantially in a horizontal plane and the underside is indicated at 16.

An elongated standard is generally indicated at 30 having a lower telescoping portion 32 and an upper telescoping portion 34 which latter slides in hollow interior of the lower portion of 30. The upper portion 34 can be fixed in a desired position of telescoping by a wing-bolt 38 of FIG. 1.

The base 12 is connected to the standard 30 by a pivot connection assembly generally indicated at 50.

The base 12 has at least a substantial portion thereof extending rearwardly from the standard 30 (the entire base is shown rearwardly of the standard 30 in FIG. 1) whereby the operator's weight can be placed on the base for supporting the standard with stability. One way to do this is to have the base 12 rested on the upper surface 72 of the seating portion 74 of a chair generally indicated at 80 in FIG. 1.

The chair 80 has a seperate seating surface 72 disposed at a regular seating height which could be varied approximately 17 inches for example. The chair 80 has legs 82 portions of which are broken away and the back 88 a portion of which is broken away in FIG. 1.

The pivot connection assembly 50 comprises a pivot bolt 90 providing a horizontal axis of pivoting 100 which is parallel to the forward edge 102 of the chair 80 whereby an operator sitting above the chair 80 with the base 12 between the operator and the upper seating surface 72 of the chair will hold the base 12 firmly in place by his or her weight and the position of the operator's calves are shown at 120, one on each side of the base 12.

And so the operator sits facing the standard 30 which latter is suitably attached by the bolt 90 and in a suitable way. For example, the bolt 90 can extend upwardly through an ear 132 attached to base extension 140 and extending upwardly therefrom, the ear having an opening therethrough receiving the bolt 40 and a lower end of the standard 30 having an opening through a solid rectangular lower metal portion 146 of the standard 30 which latter engages the right side of the ear 132 which latter is roughened at 152 for engagement with a roughened left side 156 of the lower portion 146 through which the bolt 90 extends and a wing nut 160 on the bolt 90 compresses the portion 146 against the ear 132 holding the standard in any desired adjusted position such as is shown in full lines in FIG. 1 or in a position more slantedly forward as shown in dotted lines in FIG. 1.

The base extension extends rearwardly from the pivot connection assembly 50 across the top of a narrow forward section on top of a narrow forward section 174 of the base 12 to which it is attached by a wing bolt 176 extending through the base 12 and with its head 178 in a recess 180 in the underside of the base 12, the wing bolt 176 having its shank extending through a slot 178 extending forwardly to rearwardly in the base extension 140 for the forward to rearward adjustment of the standard 30 with respect to the rearward edge 192 of the base 14.

The base 12 has its upper surface 14 located close to the top or upper seating surface 72 of the chair for the comfort of an operator. In other words the base 12 need not be vertically very thick.

Referring to FIG. 1, the rearwardly extending portion 400 of the base 12 can be seen to have an upper surface which is sufficiently free of sharply convex surfaces between outermost edges of its left and right sides as to cause it to be substantially comfortable for a user to place a portion of his body thereagainst with the majority of his weight supported between the outermost edges of the rearwardly extending portion of the base 12.

Figure 3:
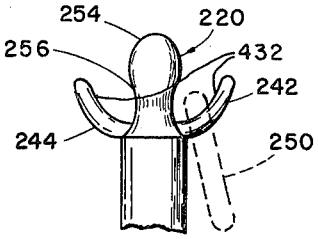
FIG. 3 is a rear elevation of a ring receiving anchor or a ring-hock, forming the upper end of the standard, a ring being shown in dotted lines thereon.

In FIG. 1 a lower hook 200 is shown protruding from the rearward side of the standard section 32 at any desired height and some may prefer it to be 12 inches from the top of the base 12 as regards vertical measurement alone. The hook 200 can be referred to as a starting hook which macrame is started and after it has reached a piece if substantial length then it can be shifted to an upper anchor assembly 220 attached to the top of the standard 30 and better shown in FIG. 3. The upper anchor assembly of FIG. 3 has hooks 242 and 244 extending out the forward and rearward sides thereof on which a ring 250 of macrame shown in dotted lines in FIG. 3 can be placed. Two rings 250 can be used and two operators since one operator can stand on the other side of the standard 30 by standing on the floor and use the other ring 244 which extends forwardly. Between the two rings 242 and 244 is a ring hock 254 about which a ring can also be disposed, the hock having a narrower portion 256 spaced downwardly from a larger upper portion for retaining a ring thereon the better.

Figure 4:
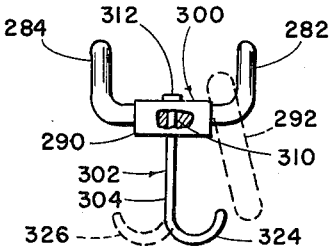
FIG. 4 is a side elevation of a special anchoring assembly for mounting on the top of the standard and which has both large ring hooks and smaller macrame loop hooks, a sample macrame loop hook being shown in full lines in use position and in dotted lines in a storage position.

In FIG. 4 a special pivot-hook anchor assembly is thereshown as would be seen from its left hand side and it has both forward and rearwardly extending large ring hooks 282 and 284 extending outwardly from a bar 290 for receiving a ring such as shown at 292 in FIG. 4.

Figure 5:
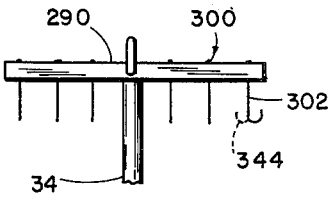
FIG. 5 is a rear elevation of a special anchoring assembly of FIG. 4 shown with most of its hooks in a use position with the lower end portions extending toward an operator disposed at the rear of the anchoring assembly of FIG. 5, one end hook being shown at optional positions of storage either twisted 90° to the right as shown in full lines for storage or else twisted 90° to the left as shown in dotted lines for storage.

The special anchoring assembly of FIG. 4 is given the general minimal 300 and it has a plurality of hooks 302 disposed in a horizontal row extending with shanks 304 vertical and extending through suitable openings one of which is shown at 310 the openings 310 extending vertically through the bar 290 and tightly but rotatably receiving the shanks 304 of for example 6 hooks 302. Each shank 304 has a head 312 above the opening 310 and larger than the opening 310. At the lower end of each shank is a transverse and upwardly curved portion 324 of each hook 302 and the latter are shown in full lines facing rearwardly toward the operator in FIG. 4 for use wheel but are shown twisted into a different position for storage and once that storage position is shown in dotted lines in FIG. 4 facing forwardly although in FIG. 5 other storage positions of the same hooks can be selected to be twisted only 90° from the use position whereby the transverse portions 324 extend either to the right or to the left as shown on a hook 302 in FIG. 5 which is to the right while all other hooks are shown in use positions in FIG. 5 and a dotted line storage position of hook 302 in FIG. 5 is shown at 344 extending to the left.

As best seen in FIG. 1, the area above the rearwardly extending base portion 400 is free of impediment to the placement of a user's body on all parts of the rearwardly extending base portion 400 while the upper portion of the user's torso is disposed directly behind the standard 30 with the user's hands occupyable with macrame-making in the area disposed above the forward end of the base or forwardly from the base 12.

Figure 6:
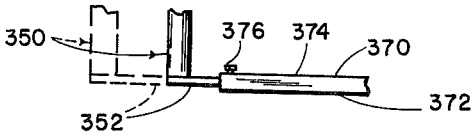
FIG. 6 is a modification of the support stand of FIG. 1.

In FIG. 6 there is a modification of the support stand of FIG. 1 in which the standard 350 is a hollow pipe having a lower lowest portion attached to a base extension 352 which latter extends horizontally rearwardly to a base 370 having a horizontal under surface 372 adapted to rest on the floor and a horizontal upper surface 374 on which the operator's feet can be placed. The extension 352 telescopes inside of the base 370 and a set screw 376 extending down through the top of the base 370 engages the base extension 352 holding it in a definite pre-set position so that the standard 350 can be pre-set in any one of many positions disposed farther or lesser far forward from the base 370.

In a sense, the base 12 can be considered to have a rearwardly extending portion 400, so called because it extends rearwardly from the standard 30, and the rearwardly extending base portion 400 has an underside having lowermost points lying substantially in horizontal plane.

A substantial portion of the operator's weight can be placed on the rearwardly extending base portion 400 for supporting the standard with stability and this applies whether the weight is placed on the portion 400 by sitting on it, or by standing on it when it is on the floor. The anchoring assembly 300 is one type of anchoring means having many hooks and the anchoring assembly 200 has but two hooks. Any of the hooks can be considered to provide a shoulder surface, 432, in the case of the anchoring assembly 200, and 20 or 438, in the case of a hook 324 of the anchoring assembly 300, the shoulder surfaces 432 and 438 being transverse to the elongation of the standard 30, the elongation being upwardly extending at time of use.

The rearwardly extending portion 400 of the base 12 can be considered to have lowermost portions, which latter portions define lower terminal portions of the stand itself, and which latter portions are disposable substantially in horizontal plane for resting on a horizontal supporting surface, such as a floor or a chair top.

I claim:

1. A macrame support stand comprising a base having a normally substantially horizontal upper surface, the underside of said base having lowermost points lying substantially in a horizontal plane, an elongated standard extending transversely to and upwardly from said base, means attaching said standard to said base capable of firmly holding said standard in place with respect to said base for remaining upright during macrame work, said standard having a plurality of sections adjacent ones of which latter telescope with respect to each other, clamping means mounted on said standard for releasably fixing adjacent sections of said standard into fixed relationships with each other for adjusting the height of said standard, said base having a substantial portion extending rearwardly from said standard on which an operator's weight can be placed for supporting said standard with stability anchoring means attached to the top of said standard and on which at least a portion of a macrame device can be held, said anchoring means comprising at least a shoulder surface transverse to the elongation of said standard.

2. The macrame stand of claim 1 in which said means for attaching said base to said standard comprises an adjustable pivoting connection whereby said standard can be firmly set at various angles with respect to the upper surface of said base whereby said standard can be set to be firmly set at various angles with respect to the upper surface of said base whereby said standard can be set to be inclined forwardly with respect to the vertical to various amounts so as to extend into various positions inclining various amounts forwardly and upwardly from said base.

3. The macrame stand of claim 2 further comprising as a part of said stand a chair under said base, and said base resting on a top of the seat of said chair whereby an operator can sit on said base, the top of said base being at a level very close to the top of said chair so that the feet of the operator can rest on the floor with the knees of the operator forwardly of at least the majority of said base.

4. The macrame support stand of claim 3 having said rearwardly extending portion of said base provided with an upper surface sufficiently free of sharply convex surfaces between the outermost edges of its left and right sides as to cause it to be substantially comfortable for a user to sit on said base with the user's buttocks extending across the outermost edges of said rearwardly extending base portion.

5. The macrame support stand of claim 1 having said rearwardly extending portion of said base having an upper surface shaped and characterized so as to be at least substantially as comfortable to sit or stand on as a hard flat horizontal surface.

6. The macrame support stand of claim 1 having said attaching means being adapted to hold said standard in a position forwardly inclining with respect to the vertical when said base is rested on a horizontal surface during macrame work.

7. The macrame support stand of claim 6, said rearwardly extending portion of said base having an upper surface shaped and characterized so as to be at least substantially as comfortable to sit or stand on as a hard flat horizontal surface.

8. The macrame support stand of claim 1 having said rearwardly extending portion of said base having an upper surface shaped and characterized so as to be at least substantially as comfortable to sit or stand on as a hard flat horizontal surface even when the user's buttocks extend across the outermost edges of said rearwardly extending portion of said base.

9. The macrame support stand of claim 1 having said anchoring means comprising a bar extending transversely to said standard, said bar having a plurality of hooks having shanks extending downwardly through said bar and rotatably received in said bar, means attached to the upper ends of said hooks for preventing said shanks from dropping through said shank, said transverse portions being disposable in use positions extending rearwardly for use but also each being adapted to be twisted into a storage position extending at least 90° from its said use position.

10. The macrame support stand of claim 1 having said anchoring means comprising at least one hook of sufficient depth to firmly hold a macrame ring during macrame work.

11. The macrame support stand of claim 1 having the majority of said base being disposed rearwardly of the lower end of said standard.

12. A macrame support stand comprising a base having a normally substantially horizontal upper surface, the underside of said base having lowermost points lying substantially in a horizontal plane, an elongated standard extending transversely to and upwardly from said base, means attaching said base to said standard, said base having a substantial portion extending rearwardly from said standard on which an operator's weight can be placed for supporting said standard with stability, anchoring means attached to the top of said standard and on which at least a portion of a macrame device can be held, said anchoring means comprising at least a shoulder surface transverse to the elongation of said standard, said rearwardly extending portion of said base having a lower surface having lowermost portions which latter portions are also lower terminal portions of said stand and which are disposable substantially in a horizontal plane for resting on a horizontal supporting surface, plus the area above said rearwardly extending portion of said base being free of impediment to the placement of a user's body on all parts of said rearwardly extending portion of said base while the upper portion of the torso of the user is disposed directly behind said standard so that the user's hands can be occupied with macrame-making in the area behind upper portions of said standard.

* * * * *